US005380246A

United States Patent [19]

Katahira

[11] Patent Number: 5,380,246

[45] Date of Patent: Jan. 10, 1995

[54] DUST SUCTION APPARATUS

[75] Inventor: Masayuki Katahira, Gunma, Japan

[73] Assignee: NSK Ltd., Tokyo, Japan

[21] Appl. No.: 36,710

[22] Filed: Mar. 25, 1993

[30] Foreign Application Priority Data

Mar. 31, 1992 [JP] Japan ..... 4-77674

[51] Int. Cl.[6] ..... B08B 15/00

[52] U.S. Cl. ..... 454/64

[58] Field of Search ..... 454/49, 63, 64

[56] References Cited

U.S. PATENT DOCUMENTS

| | | | |
|---|---|---|---|
| 3,705,545 | 12/1972 | Overmyer et al. | 454/64 X |
| 4,173,176 | 11/1979 | Svensson | 454/64 |
| 4,955,244 | 9/1990 | Katahira | 74/89.15 |

FOREIGN PATENT DOCUMENTS

| | | | |
|---|---|---|---|
| 111235 | 6/1964 | Czechoslovakia | 454/64 |
| 462135 | 7/1928 | Germany | 454/64 |
| 421551 | 3/1974 | U.S.S.R. | 454/64 |
| 918121 | 4/1982 | U.S.S.R. | 454/64 |
| 929533 | 5/1982 | U.S.S.R. | 454/64 |

*Primary Examiner*—Harold Joyce
*Attorney, Agent, or Firm*—Sughrue, Mion, Zinn, Macpeak & Seas

[57] ABSTRACT

In a dust suction apparatus, a flexible sheet is provided on the open top of a channel body which communicates with an exhaust section. An opening support member is provided in a box-shaped slider, and separates a portion of the sheet from the open top of the body so that the sheet hermetically closes the open top except at the portion, and openings are made between the side edges of the portion of the sheet and the side portions of the body, and communicate with a dust generating part. The slider is disposed on the channel body so that the slider can be moved relative to the body along the longitudinal direction thereof as the slider remains in hermetic sliding contact with the body. The dust and the air are conducted from the dust generating part into the channel body through the openings between the portion of the sheet and the side portions of the body without elongating or compressing an exhaust tube as the part is moving.

26 Claims, 3 Drawing Sheets

DUST SUCTION APPARATUS

BACKGROUND OF THE INVENTION

The present invention relates to a dust suction apparatus, and more particularly relates to a dust suction apparatus for a semiconductor-manufacturing precision positioning table unit in a clean room.

A conventional dust suction apparatus for a positioning table unit in a clean room functions so that in order to remove powders produced by wear and minute particles of lubricant or the like (hereinafter referred to as dust) are produced from a moving part, such as a ball screw apparatus, a nut, a linear movement guiding mechanism and a support bearing, the dust and air located around the moving part are forcibly sucked together by a vacuum pump and sent to an air filter to catch the dust thereon and release the air to the atmosphere to keep no-dust environment therein as disclosed in the U.S. Pat. No. 4,955,244.

FIG. 4 shows the positioning table unit and the dust suction apparatus provided therefor. The unit includes a screw shaft 20, a motor 21, a support member 23, a linear guide 24, a nut 25, a base 31, and support blocks 32 and 33. The screw shaft 20 is supported at both the ends thereof by the support blocks 32 and 33 secured to the base 31 in the clean room 30, and is coupled to the motor 21 so that the shaft can be rotated by the motor. The linear guide 24 includes a bearing **24*a* and a rail 24*b*. The nut 25 is engaged with the screw shaft 20 and supported by the support member 23 and the linear guide 24 so that the nut can be straightly moved while being guided by the member and the guide. The nut 25 has a hole 22 extending from the outer surface of the nut to the inner surface thereof. The dust suction apparatus includes a spiral exhaust tube 26, a support means 26*a*, a suction pipe 26*b*, an dust suction pump 27, an air filter 28, a dust counter 34, and a control device 35. The spiral exhaust tube 26 is connected to the hole 22 of the nut 25 by a nipple, and supported by the support means 26*a* so that the tube can be elongated and compressed along the support means. The suction pipe 26*a* connects the exhaust pipe 26 to the dust suction pump 27. When the motor 21 of the table unit is put in action, the nut 25 is moved on the screw shaft 20 in a direction corresponding to that of the rotation of the motor. At that time, the dust generated at the nut 25 in the clean room 30 is sucked together with the air by the dust suction pump 27 through the exhaust tube 26 and the suction pipe 26*b* so that the dust is caught by the air filter 28, and the air is then returned to the clean room 30. An environmental servo system is composed of the dust counter 34 and the control device 35. The concentration of the dust in the clean room 30 is always monitored by the dust counter 34. Only when the concentration is lower that a prescribed level, the control device 35 acts to put the motor 21** in action.

Although the conventional dust suction apparatus which is of the vacuum suction type in which a dust generating part is subjected to vacuum suction to remove dust collects the dust effectively, the apparatus has problems that the exhaust tube 26 and the suction pipe **26*b*** occupy spaces inside and outside the positioning table unit to restrict the travel of the table thereof, and the exhaust tube is moved along the movement of the table so as to make it likely to generate other dust.

SUMMARY OF THE INVENTION

The present invention was made in order to solve the above-mentioned problems. Accordingly, it is an object of the invention to provide a dust suction apparatus having a means for removing dust together with air without elongating or compressing an exhaust tube in a draging manner.

In the apparatus, a flexible sheet is disposed on the open top of a channel body which communicates with an exhaust section. An opening support member is provided in a box-shaped slider, and separates a portion of the sheet from the open top of the body so that the sheet hermetically closes the top except at the portion, and openings are made between the side edges of the portion and the side portions of the body, and communicate with a dust generating part. The slider is disposed on the channel body so that the slider can be moved relative to the body along the longitudinal direction thereof as the slider remains in hermetic sliding contact with the body. As a result, the dust can be conducted together with the air from the dust generating part into the channel body through the openings without elongating or compressing the exhaust tube in a draging manner as the dust generating part is moving.

The dust suction apparatus provided in accordance with the present invention can be applied to an optional device having the dust generating part which usually moves in mechanical contact.

For example, the device is a positioning table unit. The channel body of the dust suction apparatus is disposed in parallel with the screw shaft of the ball screw means of the table unit, closed at one end of the body, and open at the other end thereof so that the body communicates with the exhaust section. The flexible sheet is made of a metal, and magnetically attracted on the open top of the body so that the sheet hermetically closes the top to form an exhaust passage in the body. The box-shaped slider is disposed on the open top of the body so that the slider can be moved relative to the body along the longitudinal direction thereof as the sliding skirt of the slider remains in hermetic sliding contact with the body to keep external air from entering into the slider. The opening support member is provided in the slider to lift the portion of the sheet from the open top of the body to make the openings between the side edges of the portion of the sheet and the side portions of the body so that the dust and the air can be conducted into the exhaust passage in the body through the openings. A communication passage is connected to the slider so that the dust generating part of the table unit communicates with the exhaust passage in the channel body through the communication passage and the openings. The dust and the air are conducted from the dust generating part into the slider through the communication passage so that the dust and the air flow into the channel body through the openings, and then proceed to the exhaust section. When the ball screw means is put in action, the nut of the means is moved on the screw shaft thereof along the longitudinal direction of the shaft so that the slider is moved relative to the channel body along the longitudinal direction thereof, and the support member is also moved relative to the body along the longitudinal direction thereof while supporting the flexible sheet at the portion thereof up from the body to make the openings between the side edges of the sheet and the side portions of the body. At that time, the dust and the air are conducted from the dust generating part into the slider through the communication passage so that the dust and the air flow out of the slider into the channel body through the openings, and then proceed from the body to the exhaust section. Even if dust is generated due to the sliding of the portion of the support member on the flexible sheet, the dust does not go out of the apparatus but flows from the slider into the channel body because the support member is located in the slider.

BRIEF DESCRIPTION OF THE DRAWINGS

FIG. 1(*b*) is a plan view of the apparatus taken along line A—A in FIG. 1*a;*

FIG. 1(*c*) is a cross-sectional view of the apparatus;

FIG. 2(*b*) is a cross-sectional view of the apparatus of the second embodiment to illustrate the secured portion of the opening support member thereof to the slider thereof;

FIG. 2(*c*) is a cross-sectional view of the apparatus of the second embodiment to illustrate the communication holes of the support member;

DETAILED DESCRIPTION OF THE PREFERRED EMBODIMENTS

Embodiments of the present invention are hereafter described with reference to the drawings attached hereto.

Figure 1A:
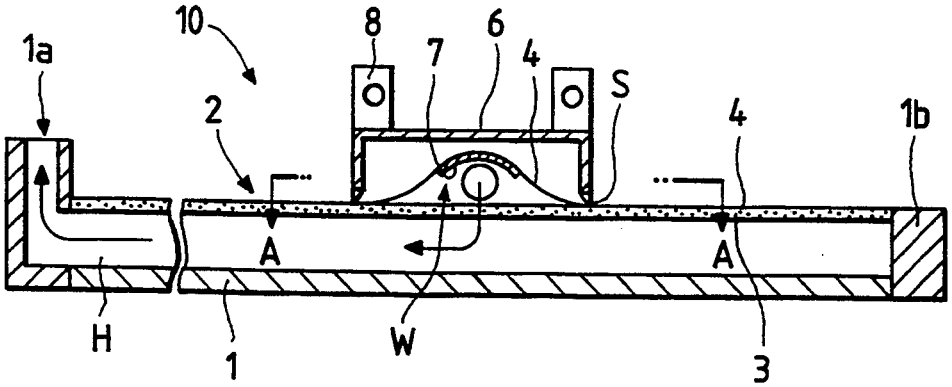
FIG. 1(*a*) is a longitudinally sectional view of a dust suction apparatus which is a first embodiment of the present invention.
Figure 1B:
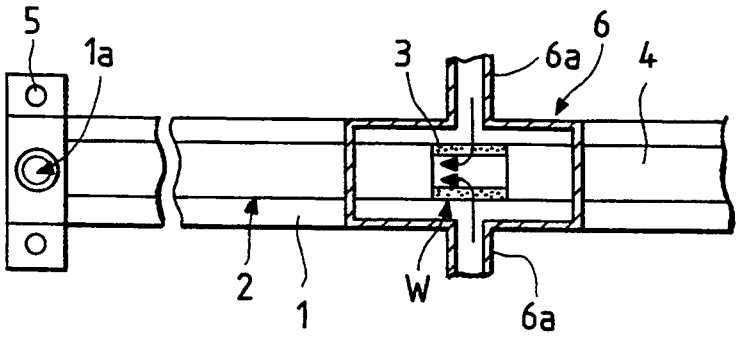
Figure 1C:
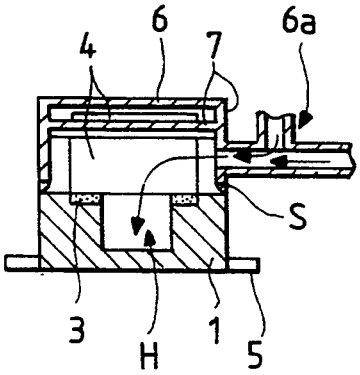

FIG. 1 shows a dust suction apparatus 10 which is a first embodiment. The apparatus 10 includes a channel body 1, an exhaust means not shown in FIG. 1, band-like magnets 3, a flexible metal sheet 4, a slider 6, and an opening support member 7.

The channel body 1 has a U-shaped cross section, an exhaust port 1*a* provided at one end of the body (at the left-hand end thereof as to FIG. 1) and communicating with the exhaust means, and an end plate 1*b* closing the body at the other end thereof. The band-like magnets 3 extend on the inner surfaces of both the side portions of the body 1 at the open top 2 thereof so that the flexible metal sheet 4 can be magnetically attracted on the magnets to hermetically close the open top. The body 1 and the sheet 4 thus constitute a duct means having an exhaust passage H communicating with the exhaust means. A plastic sheet may be provided instead of the metal sheet 4 so as to be put in tight contact with the side portions of the body 1 by negative pressure therein to hermetically close the open top 2 of the body. The body 1 has flanges 5 secured to the base of a positioning table unit from which dust is to be removed by the apparatus 10.

The slider 6 is shaped as a box, and open at the bottom thereof. A communication passage 6*a* extends from the side of the slider 6 so that the dust and air can be conducted from the moving part of the table unit to the internal opening 6 through the passage. The slider 6 has a skirt S in hermetic sliding contact with the tops of the side portions of the body 1 so that the slider can be moved relative to the body along the longitudinal direction thereof. The slider 6 has flanges 8 secured to the moving part of the table unit.

The opening support member 7 is provided in the slider 6, and supports the metal sheet 4 at a portion thereof up from the magnets 3 so that openings W are made between the side edges of the portion of the sheet and the side portions of the body 1, and one of the openings faces the end of the communication passage 6*a* in the slider 6. The member 7 is a plate bent as an arc, and borne in the slider 6 to lift the metal sheet 4 at the portion thereof to make the openings W between the side edges of the portion and the side portions of the body 1.

Figure 2A:
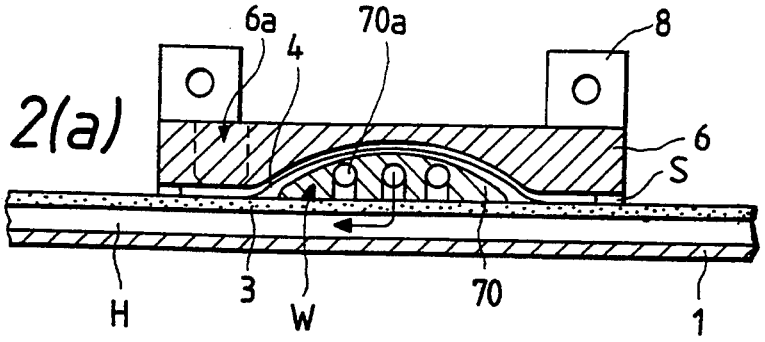
FIG. 2(*a*) is a longitudinally sectional view of a dust suction apparatus which is a second embodiment of the invention.
Figure 2B:
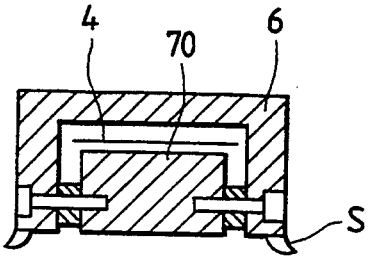
Figure 2C:
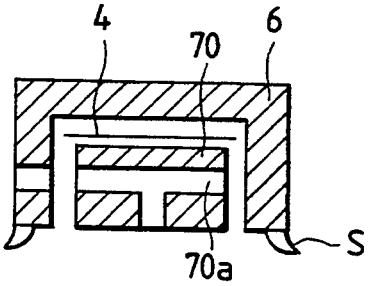

FIG. 2 shows a dust suction apparatus which is a second embodiment. The apparatus includes an opening support member 70 which has a crescent-shaped longitudinal section and communication holes 70*a* through which both the sides of the member communicate with the bottom thereof. The apparatus also includes a channel body 1, band-like magnets 3, a flexible metal sheet 4, and a box-shaped slider 6. The support member 70 is disposed in the slider 6. A communication passage 6*a* extends from the dust generating part of a positioning table unit to the upper portion of the slider 6 so that dust and air are conducted from the part into the slider through the passage, flow into the communication holes 70*a* of the support member 70 through openings between the side edges of a portion of the metal sheet 4 and the side portions of the slider and through the sides of the support member, and finally enter into the exhaust passage H of the body 1 through the bottom of the support member. The distance between the side portions of the slider 6 is larger than the width of the metal sheet 4 so that the width of each of the openings between the side edges of the portion of the sheet and the side portions of the slider is large enough to enable the dust and the air to smoothly flow through the openings.

Reference numeral 8 disignates a flange member for mounting the slider 6 to a movable member from which a dust is sucked.

Figure 3:
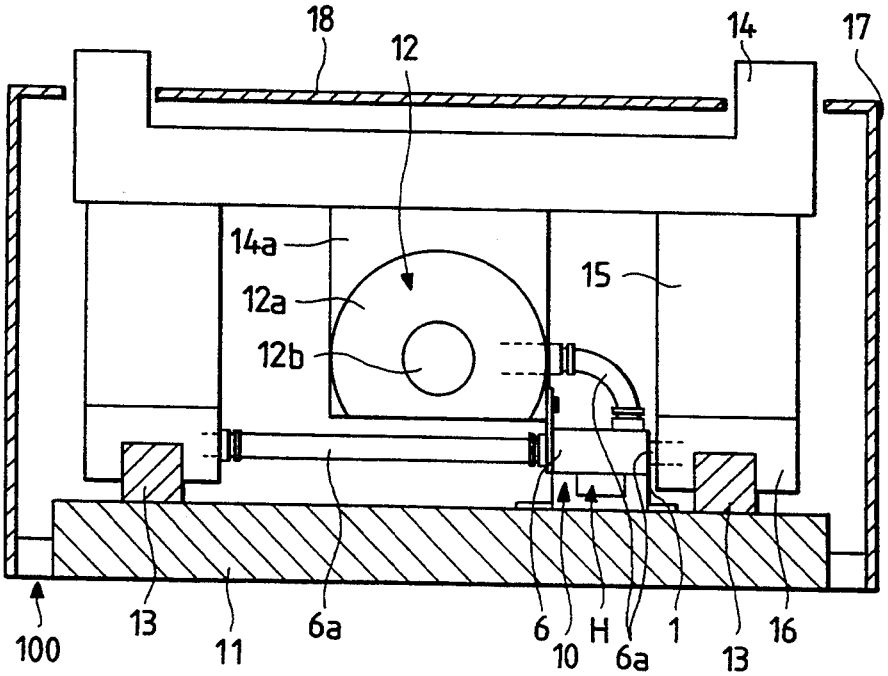
FIG. 3 is a cross-sectional view of a positioning table unit provided with the dust suction apparatus.
Figure 4:
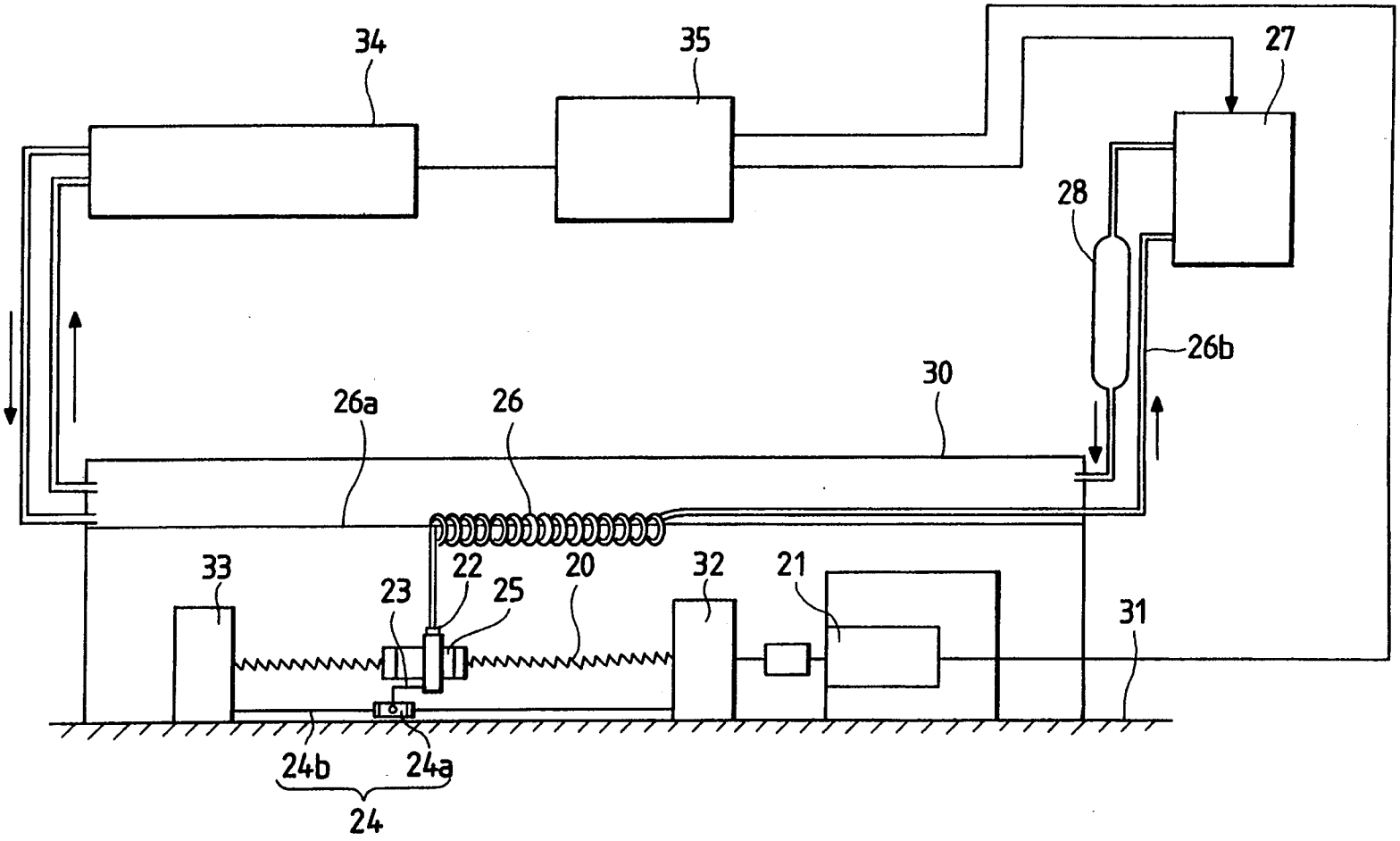
FIG. 4 PRIOR ART
FIG. 4 is a schematic view of a positioning table unit provided with a conventional dust suction apparatus.

An example of use of each of the dust suction apparatuses for the positioning table unit 100 is described with reference to FIG. 3 from now on. The unit 100 includes a long base 11, a ball screw means 12, two linear guide rails 13, a table 14, spacers 15, linear guide bearings 16, and sound insulation covers 17 and 18. The base 11 is secured to the floor of a clean room in which the suction apparatus and the table unit are installed. The ball screw means 12 is supported by the base 11, and extends in parallel therewith. The guide rails 13 extend at both the sides of the screw 12*b* of the ball screw means 12 in parallel with the shaft. The table 14 is supported through a bracket 14*a* by the nut 12*a* of the ball screw unit 12, the guide rails 13, the spacers 15 and the bearings 16 so that the table can be straightly moved back and forth while being guided by the rails. The table 14 is connected to the motor of the table unit 100 through the nut 12*a* and screw shaft 12*b* of the ball screw means 12. When the motor connected to the screw shaft 12*b* through a coupling is rotated, the nut 12*a* engaged with the shaft and the table 14 are straightly moved together back or forth.

The body 1 of the dust suction apparatus 10 extends in parallel with the screw shaft 12*b* and the linear guide rails 13. The slider 6 is secured at the flanges 8 thereof to the sides of the nut 12*a* so that the dust and the air at the nut 12*a* are conducted therefrom into the slider 6 through the communication passage 6*a* and the top of the slider and the dust and the air at the linear guide bearings 16 are conducted therefrom into the slider through the other communication passage 6a and the side of the slider as the apparatus is in action. The sound insulation cover 17 constitutes both sides and both ends of the table unit 100, the other sound insulation cover 18 constitutes a part of the top of the unit, so that the covers prevent internal noises from going out of the unit.

When the motor of the positioning table unit 100 is put in action, the table 14 thereof, the nut 12a engaged with the screw shaft 12b and the slider 6 secured to the nut are moved together along the linear guide rails 13. At that time, the slider 6 remains in hermetic sliding contact with the side portions of the channel body 1 of the dust suction apparatus 10 through the skirt S.

As for the dust suction apparatus including the opening support member 7 shown in FIG. 1, the member lifts the flexible metal sheet 4 at the portion thereof to make the openings W and is moved along the exhaust passage H in the channel body 1 of the apparatus. The dust generated at the nut 12a and the two linear guide bearings 16 is conducted together with the air into the slider 6 through the communication passages 6a through the side of the slider 6 so that the dust and the air flow into the exhaust passage H in the body 1 through the openings W, and then proceed to the exhaust means of the apparatus through the exhaust port 1a.

As for the dust suction apparatus including the opening support member 70 shown in FIG. 2, the dust generated at the nut 12a is conducted together with the air into the slider 6 through the communication passage 6a and the top of the slider, the dust generated at the linear guide bearings 16 is conducted together with the air into in the slider through the other communication passage 6a and the side of the slider, so that the dust and the air flow into the exhaust passage H in the channel body 1 of the apparatus through the openings between the side edges of the flexible metal sheet 4 and the side portions of the slider, the openings W between the sheet and the magnets 3, and the communication holes 70a, and then proceed to the exhaust means of the apparatus through the exhaust port 1a thereof.

The exhaust system of each of the dust suction apparatuses is simpler and more compact than that of the conventional dust suction apparatus despite the constitution of each of the opening support members 7 and 70, and does not interfere with an ambient member nor is elongated or compressed as the latter. Besides, the flow of the air in the exhaust system of each of the apparatuses which are the embodiments appropriately cools the system.

The present invention is not confined to the embodiments, but may be embodied or practiced in other various ways without departing from the spirit or essential character of the invention. For example, the invention may be embodied as a dust suction apparatus for a device which is not a positioning table unit and has a moving part at which dust is generated.

In a dust suction apparatus provided in accordance with the present invention, a flexible sheet is disposed on the open top of a channel body which communicates with an exhaust means, and an opening support member is disposed in a box-shaped slider, and separates a portion of the sheet from the body so that the sheet hermetically closes the open top thereof except at the portion, and openings are made between the side edges of the portion of the sheet and the side portions of the body. Since the slider is moved as the dust generating part of a device from which dust is to be removed by the apparatus communicates with exhaust means through the openings, the exhaust men%her of the apparatus is not elongated or compressed. Besides, the space occupied by the apparatus at the device is minimized. The dust is sucked together with air from the dust generating part into the channel body of the apparatus through the openings between the flexible sheet and the body so that the dust and the air are discharged from the body, and the dust is removed. Since the suction of the air acts to cool the apparatus and the device, the accuracy of their operation can be enhanced. The apparatus and the device can thus be made compact and high in accuracy and stability of operation in a clean room.

What is claimed is:

1. A dust suction apparatus for sucking dust generated at atleast one of a linear movement guiding member and a ball screw member of a linearly movable table positioning unit comprising:

a channel body communicating with an exhaust section and having an open top extending in a longitudinal direction of said channel body, said channel body being arranged in parallel with at least one of a linear guide rail of said linear movement guiding member and a screw shaft of said ball screw member;

a flexible sheet for hermetically closing said open top;

a sliding member movable on said body along the longitudinal direction of said body while said sliding member remains in hermetic sliding contact with said body; and an opening forming means provided in said sliding member for continuously separating a portion of said sheet from said open top so that said sheet hermetically closes said open top except at said portion, and for forming openings which communicate with said at least one of said linear movement guiding member and said ball screw member through a communication passage.

2. A dust suction apparatus according to claim 1, in which said flexible sheet is made of metal.

3. A dust suction apparatus according to claim 2 further comprising:

a band-shaped magnet member for magnetically contact with said metal flexible sheet, said band-shaped magnet member provided at both the side portions of said body at said open top thereof.

4. A dust suction apparatus according to claim 1, in which said sliding member comprises a box-shaped slider which opens at the bottom thereof and a skirt in hermetic sliding contact with the side portions of said body.

5. A dust suction apparatus according to claim 3, in which said sliding member comprises a box-shaped slider which opens at the bottom therefor and a skirt in hermetic sliding contact with the side portions of said body.

6. A dust suction apparatus according to claim 1, in which said opening forming means comprises an arch-shaped plate which is mounted in said sliding member to lift the sheet at said portion thereof so as to make said openings between the side edges of said portion and the side portions of said body.

7. A dust suction apparatus according to claim 3, in which said opening forming means comprises an arch-shaped plate which is mounted in said sliding member to lift the sheet at said portion thereof so as to make said openings between the side edges of said portion and the side portions of said body.

8. A dust suction apparatus according to claim 4, in which said opening forming means comprises an arch-shaped plate which is mounted in said sliding member to lift the sheet at said portion thereof so as to make said openings between the side edges of said portion and the side portions of said body.

9. A dust suction apparatus according to claim 5, in which said opening forming means comprises an arch-shaped plate which is mounted in said sliding member to lift the sheet at said portion thereof so as to make said openings between the side edges of said portion and the side portions of said body.

10. A dust suction apparatus according to claim 1, in which said opening forming means comprises a support member which has a crescent-shaped longitudinal section and communication holes through which both the sides of said support member communicate with the bottom thereof.

11. A dust suction apparatus according to claim 3, in which said opening forming means comprises a support member which has a crescent-shaped longitudinal section and communicates holes through which both the sides of said support member communicate with the bottom thereof.

12. A dust suction apparatus according to claim 4, in which said opening forming means comprises a support member which has a crescent-shaped longitudinal section and communication holes through which both the sides of said support member communicate with the bottom thereof.

13. A dust suction apparatus according to claim 5, in which said opening forming means comprises a support member which has a crescent-shaped longitudinal section and communication holes through which both the sides of said support member communicate with the bottom thereof.

14. A linear movable table positioning unit including a dust suction apparatus for sucking dust generated at at least one of a linear movement guiding member and a ball screw member of said linearly movable table positioning unit comprising:

a channel body communicating with an exhaust section and having an open top extending in a longitudinal direction of said channel body, said channel body being arranged in parallel with at least one of a linear guide rail of said linear movement guiding member and a screw shaft of said ball screw member;

a flexible sheet for hermetically closing said open top;

a sliding member movable on said body along the longitudinal direction of said body while said sliding member remains in hermetic sliding contact with said body; and an opening forming means provided in said sliding member for continuously separating a portion of said sheet from said open top so that said sheet hermetically closes said open top except at said portion, and for forming openings which communicate with said at least one of one of said linear movement guiding member and said ball screw member through a communication passage.

15. A linear movable table positioning unit according to claim 14, in which said flexible sheet is made of metal.

16. A linear movable table positioning unit according to claim 15, said dust suction apparatus further comprising:

a band-shaped magnet member provided at both the side portions of said body at said open top thereof for magnetically attracting said metal flexible sheet.

17. A linear movable table positioning unit according to claim 14, in which said sliding member comprises a box-shaped slider which has an open portion at the bottom thereof and a skirt formed around said open portion and in hermetic sliding contact with the side portions of said body.

18. A linear movable table positioning unit according to claim 16, in which said sliding member comprises a box-shaped slider which has an open portion at the bottom thereof and a skirt formed around said open portion and in hermetic sliding contact with the side portions of said body.

19. A linear movable table positioning unit according to claim 14, in which said opening forming means comprises an arch-shaped plate which is mounted in said sliding member to lift the sheet at said portion thereof so as to make said openings between the side edges of said portion and the side portions of said body.

20. A linear movable table positioning unit according to claim 16, in which said opening forming means comprises an arch-shaped plate which is mounted in said sliding member to lift the sheet at said portion thereof so as to make said openings between the side edges of said portion and the side portions of said body.

21. A linear movable table positioning unit according to claim 17, in which said opening forming means comprises an arch-shaped plate which is mounted in said sliding member to lift the sheet at said portion thereof so as to make said openings between the side edges of said portion and the side portions of said body.

22. A linear movable table positioning unit according to claim 18, in which said opening forming means comprises an arch-shaped plate which is mounted in said sliding member to lift the sheet at said portion thereof so as to make said openings between the side edges of said portion and the side portions of said body.

23. A linear movable table positioning unit according to claim 14, in which said opening forming means comprises a support member which has a crescent-shaped longitudinal section and communication holes formed therein through which both the sides of said support member communicate with the bottom thereof.

24. A linear movable table positioning unit according to claim 16, in which said opening forming means comprises a support member which has a crescent-shaped longitudinal section and communication holes formed therein through which both the sides of said support member communicate with the bottom thereof.

25. A linear movable table positioning unit according to claim 17, in which said opening forming means comprises a support member which has a crescent-shaped longitudinal section and communication holes formed therein through which both the sides of said support member communicate with the bottom thereof.

26. A linear movable table positioning unit according to claim 18, in which said opening forming means comprises a support member which has a crescent-shaped longitudinal section and communication holes formed therein through which both the sides of said support member communicate with the bottom thereof.

* * * * *